US005713164A

United States Patent [19]

Ryan

[11] Patent Number: 5,713,164

[45] Date of Patent: Feb. 3, 1998

[54] POOL LINER INSTALLATION SYSTEM

[76] Inventor: Richard T. Ryan, Box 88030 RPO 60 2975 Kingston Rd., Scarbourgh, Canada

[21] Appl. No.: 596,403

[22] Filed: Feb. 2, 1996

[51] Int. Cl.[6] ..... B04H 4/14

[52] U.S. Cl. ..... 52/169.7; 4/506; 52/741.4

[58] Field of Search ..... 417/423.2, 423.8, 417/423.18; 415/206, 203, 175, 176, 177, 178; 52/169.7, 741.4, 745.9; 4/506

[56] References Cited

U.S. PATENT DOCUMENTS

| | | | |
|---|---|---|---|
| 3,095,821 | 7/1963 | Elenbaas | 415/206 X |
| 3,502,030 | 3/1970 | Bukewihge et al. | 417/423.13 |
| 3,733,151 | 5/1973 | Timmons et al. | 417/423.8 |
| 4,065,233 | 12/1977 | Torigoe et al. | 417/423.2 X |
| 4,728,266 | 3/1988 | Matsumoto et al. | 417/423.2 X |
| 4,773,829 | 9/1988 | Vettori | 417/423.8 X |
| 5,296,769 | 3/1994 | Havens et al. | 417/423.2 X |
| 5,431,548 | 7/1995 | Koble, Jr. | 417/423.8 |
| 5,454,690 | 10/1995 | Wolfe et al. | 417/423.8 |
| 5,551,836 | 9/1996 | Roth et al. | 415/206 X |
| 5,573,369 | 11/1996 | Du | 417/423.2 X |
| 5,601,400 | 2/1997 | Kondo et al. | 415/206 X |

*Primary Examiner*—Michael Safavi
*Attorney, Agent, or Firm*—D. W. Eggins

[57] ABSTRACT

The installation of a vinyl liner within an in-ground swimming pool is carried out using a direct drive, over-hung vacuum machine to exhaust air from between the liner and the steel walls and cement bowl within which the liner is installed. The vacuum machine has the overhung impellor located within a volute chamber isolated from the driving electric motor, so that the induced air flow is segregated from the driving motor. The vacuum machine impellor is of non-corrosive material, to avoid corrosion of the impellor when water is entrained, and to avoid the consequent imbalance and undue wear of the bearing that would otherweise ensue. The paddle-style impellor blades ensure that the vacuum suction is insufficient to cause intake of the pool liner into the air-evacuation hose.

5 Claims, 2 Drawing Sheets

POOL LINER INSTALLATION SYSTEM

FIELD OF THE INVENTION

This invention is directed to a system for installing pool liners within in-ground swimming pools, and in particular to a vacuum machine and fittings for use with the system.

BACKGROUND TO THE INVENTION

The use of in-ground swimming pools is so widespread in the southern United States that a pool installation and servicing industry has grown up.

One very popular pool construction comprises an inground steel wall and cement bowl within which is installed a plastic liner, generally of vinyl.

With the liner positioned within the cement bowl it has been the practice, using shop vacuum machines or other domestic vacuums, to exhaust air from between the linen and its bowl, so as to enable precise fitting of the liner in place, prior to filling with water, to hold it in position. However, such uses of orthodox vacuum machines suffers from a number of disadvantages.

A major disadvantage is the reliance of the usual type of vacuum machine on the passage of the exhausted air through the electric motor of the machine, for cooling purposes. The presence of water, which can readily happen, can either short circuit the motor, or require the provision of a centrifugal separator to eliminate the water.

Also, upon achieving complete or near-complete draw-down of the liner, the air flow is correspondingly diminished or even substantially terminated, so that the electric motor accelerates, while it also overhears, frequently to the point of trip-out, due to the absence of cooling air flow.

While causing interuption of the work of installation, these happenings also can drastically shorten the life of the vacuum machines, and constitute a safety hazard.

In addition to the foregoing prior practice, search of the prior art has led to the following United States patents: U.S. Pat. No. 4,187,654 Constantinescu shows the use of a complex suction track network, to enable suctioning of the pool bottom, which consists of a special channelled tile arrangement. This system uses a water separator in combination with a suction pump of unspecified type.

U.S. Pat. No. 4,368,550 Stevens uses the positive pressure (exhaust) side of a vacuum blower to purge the water skimmer lines of the pool "plumbing" for winterizing. This system requres the use of check valves in these lines. U.S. Pat. No. 3,816,859 Mosehauer uses a vacuum machine to inflate and deflate a sinkable pool cover, to raise or sink the cover. The following patents are of slight interest, being directed to different aspects of pool construction: U.S. Pat. No. 3,811,236 Fiddes; U.S. Pat. No. 3,938,199 Laven; U.S. Pat. No. 3,660,957 Schankler; U.S. Pat. No. 4,230,170 Lankheet; U.S. Pat. No. 4,142,337 Holcomb.

The following 3-patents are directed to motor or blower systems associated with power saws.

U.S. Pat. No. 4,491,047 Butkewicz . . . Bandsaw motor mount;

U.S. Pat. No. 4,638,695 Striebig . . . Sawdust duct associated with the circular saw blade;

U.S. Pat. No. 5,146,682 Blochle et al: shows a so-called Skill-saw with a built-in sawdust blower.

SUMMARY OF THE INVENTION

The present invention provides a vacuum machine for use in drawing a substantially impermeable membrane into close fitting relation with at least one surface of predetermined form, the machine having a volute chamber including an inlet and an outlet for the transfer of fluids therethrough; an impellor rotatably mounted within the chamber upon a shaft extending through a side wall of the chamber; and motor means including self-cooling means therefor located externally of the side wall and secured to the impellor in remote driving relation therewith, whereby in use, upon operation of the motor in driving relation with the impellor, cooling air passes through the motor independently of fluid passing through the impellor.

In a preferred embodiment the impellor is of non-corrosive material, in use to preclude corrosion thereof in the presence of moisture.

The impellor may have paddle-like blades, shaped to generate turbulence within the volute chamber at low air flow rates, and to provide a predetermined, limited degree of diminished suction at the inlet thereof at low and zero air flow rates through the impellor.

The vacuum machine of the present invention may be used in combination with an in-ground pool bowl having a plastic liner in substantially fitting relation with at least a portion of the pool bowl; the liner and the pool bowl defining therebetween an interstitial space; the combination including a hose of predetermined flow capacity connecting the volute chamber inlet with the interstitial space, to enable the exhaustion of fluids located within the interstitial space through the machine volume chamber.

BRIF DESCRIPTION OF THE DRAWINGS

Certain embodiments of the invention are described by way of illustration, without limitation of the invention thereto other than as set forth in the accompanying claims, reference being made to the accompanying drawings wherein:

DETAILED DESCRIPTION OF THE INVENTION

Figure 1:
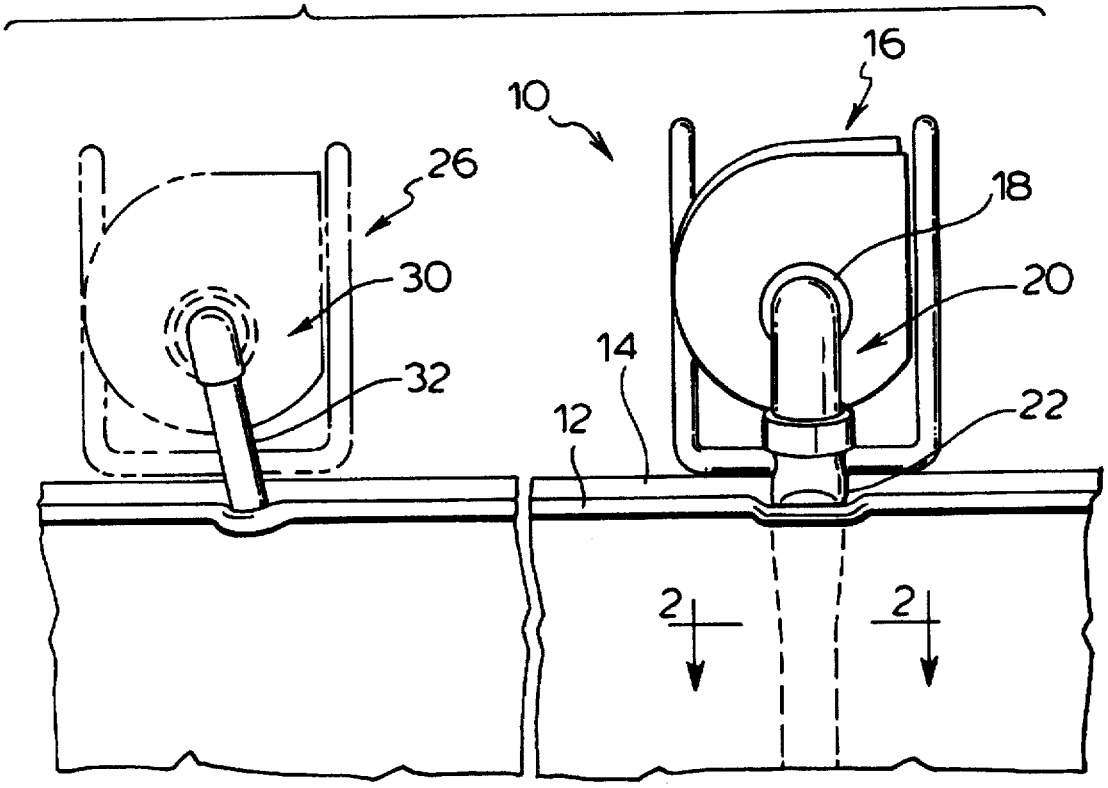
FIG. 1 is a frontal view of a system in accordance with the invention, showing in full-line a first embodiment in accordance herewith, in use; and in phantom, a second embodiment in use.
Figure 2:
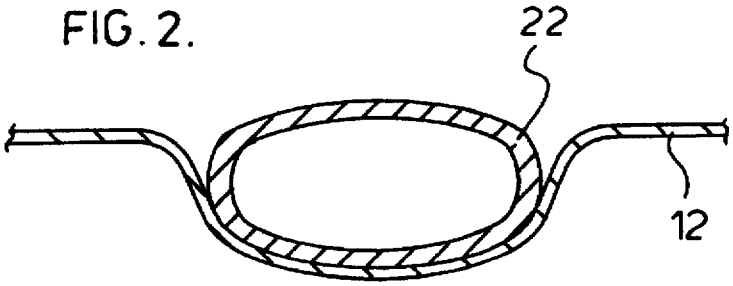
FIG. 2 is a section taken at 2—2 of FIG. 1.

Referring to FIG. 1, the system embodiment 10 shows the side of an in-ground pool, having a reduced within the steel-walled, concrete bottomed pool basin, of which the lip 14 is seen. The blades are substantially planar, having radially outer edges that are advanced in the direction of rotation of the impellor, relative to the radially inner edges of the blades. The full-line illustrated embodiment shows a vacuum machine 16 having a central air inlet 18 fitted with a removable suction inlet 20. The suction inlet 20 includes an elongated, removable flattened nozzle portion 22, a section of which appears in FIG. 2. The elongated, flattened nozzle 22 may be in the order of 40 inches or so in length, in-part to diminish edge leakage of air, downwardly from the point of insertion of nozzle 22 behind the liner 12. The full-line embodiment represents a four-inch diameter inlet 20, having the nozzle 22 of corresponding section. The above referred-to reduced suction provided by the paddle-like planar blades at low air-flow conditions is such that, while the exhaustion of air from the interstitial space is maintained so as to keep the liner drawn about the suction intake, the liner is not drawn into the suction intake. This reduced suction, as attributed above to the generation of turbulence by the impellor blades, may also be due, in-part, to the orientation of the blades, with the radially outer edges advanced in the direction of rotation of the impellor, in leading relation to the radially inner edges of the blades.

The phantom-lined machine embodiment 26 having a two-inch diameter inlet 30 and a flattened nozzle 32 of corresponding section.

I have found that care must be taken in selecting suction line sizes, so that the substitution of two, one and one-half inch diameter suction lines, connected in-parallel, in place of one, two-inch suction line, can lead to unsatisfactory operation of the system.

I have found that a 1-horsepower (electrical) vacuum machine installation in accordance with the invention can effectively service a pool system, using one four-inch suction line, or using two, two-inch suction lines connected in parallel from a four-inch header. The 1-H.P. motor is preferably a commercial induction motor, having the comparatively low rotor speed of 3450 r.p.m. under load, as compared with shop-vacs of prior art.

Figure 3:
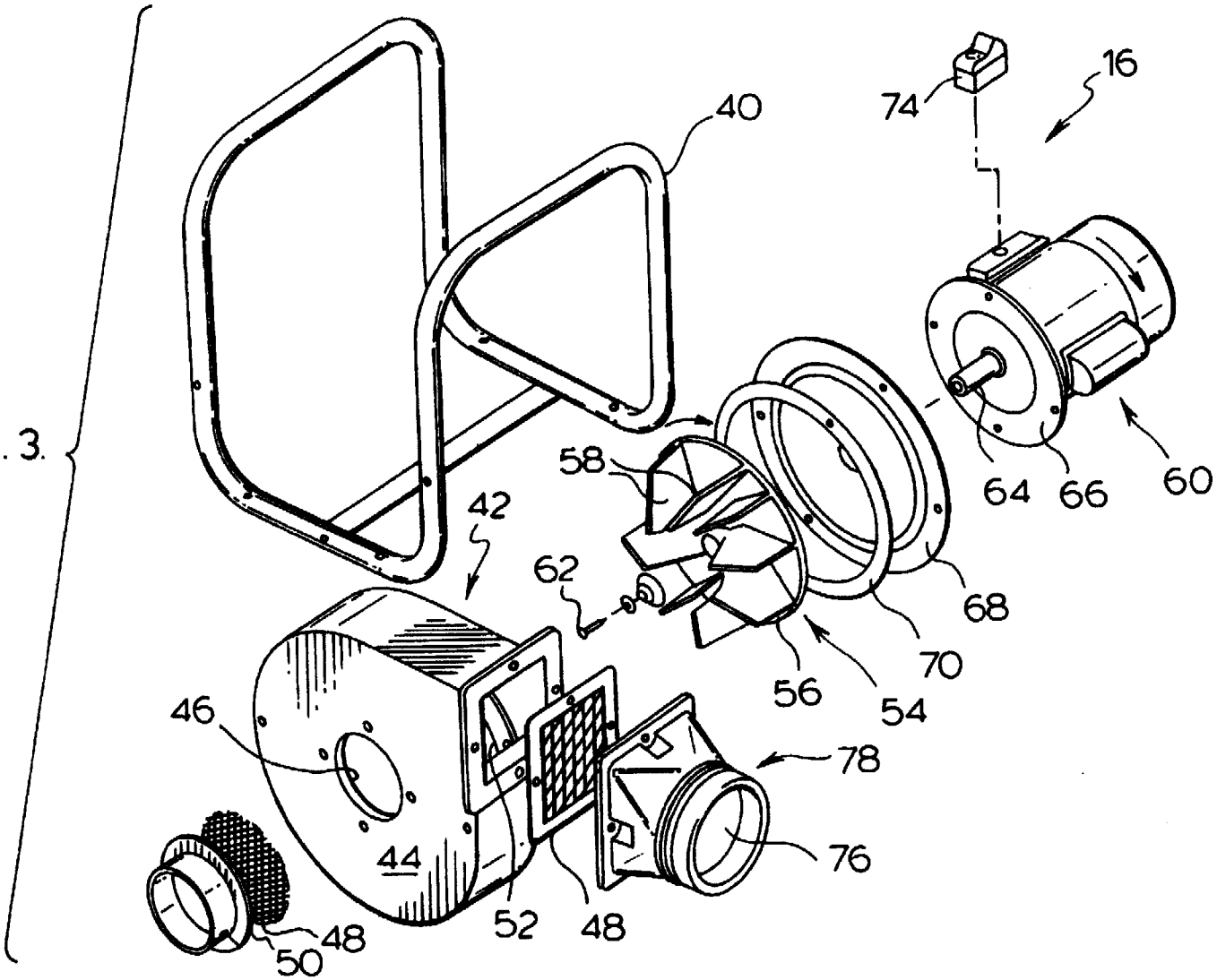
FIG. 3 is an exploded view, in front side perspective, of a vacuum machine in accordance with the invention.

Referring to FIG. 3, the illustrated major components of the vacuum machine 16 comprise a supporting frame 40 to which a volute casing 42 is secured. The inlet (front) planar face 44 of the casing 42 has an inlet aperture 46, to which a coarse mesh filter 48 and inlet adaptor 50 are secured by screws (not shown).

The rear planar face of the casing 42 has an impellor aperture 52 through which the vacuum impellor 54 is entered into the casing.

The impellor 54 is preferably molded of high strength engineering plastic, to resist abrasion and corrosion from moist air, air-born particles and water, which may be drawn out from the interstitial space formed between liner 12 and the pool basin.

The illustrated impellor 54 has a back disc portion 56, with planar blade portions 58 extending normal thereto.

The radially outer edges of blade portions 58 have an advanced lead, relative to the respective radially inner edges, in accordance with the direction of rotation of the impellor 54, shown as being clockwise.

The impellor 54 is driven by electric motor 60, the impellor 54 being secured by screw 62 to the output shaft 64 of the motor 60.

The motor 60 has its own internal cooling fan.

The motor 60 has a mounting flange 66, with which it is secured to adaptor flange 68. The adaptor flange 68 and gasket 70 are bolted in sealing engagement to the rear face of casing 42.

The impellor 54 extends in centered relation through the case aperture 52, in use to transfer air from inlet 46 to the exhaust outlet 76.

An on/off electrical switch 74 controls the operation of the system. In view of the damp or wet working environment, the use of an in-line ground-fault circuit breaker in the electrical supply circuit is strongly advocated, on grounds of safety.

The air outlet 76 also includes a coarse mesh filter 48 and an outlet connector 78, suitable for the connection of a five inch flexible exhaust hose thereto, if desired.

The machine embodiment 26 differs from the embodiment 16 only in the smaller (2-inch) diameter of the central air inlet. This down-sizing is achieved by the use of a reducing adaptor.

COMMERCIAL UTILIZATION

The eminent practical success of this system indicates probable widespread use in the pool installation and servicing industry.

What I claim by Letters Patent of the United States is:

1. A vacuum machine in combination with an in-ground pool bowl and a plastic liner positioned in substantially fitting relation with at least a portion of the pool bowl; said liner and said pool bowl defining therebetween an interstitial space; said combination including a hose of predetermined flow capacity connecting said machine with said interstitial space, to enable the exhaustion of fluids located within said interstitial space through said machine directly to atmosphere, to draw said liner into intimate contact with said bowl, said machine having a volute chamber; an impellor having a back disc portion, a plurality of substantially planar blades extending substantially normal to said back disc portion, said blades each having a radially outer edge and a radially inner edge, said radially outer edge having an advanced lead in the direction of rotation of the impellor when in use, relative to said radially inner edge, said machine impellor blades providing reduced suction at the inlet of said hose when said interstitial space is substantially eliminated and air-flow is restricted, such that said plastic liner is not readily entrained within said inlet.

2. The combination as set forth in claim 1, said impellor being of non-corrosive material, in use to preclude corrosion thereof in the presence of moisture.

3. The combination as set forth in claim 1, said impellor substantially planar blades being paddle-like to generate turbulence within said volute chamber at reduced rates of air flow, and to provide a reduced degree of suction at said reduced flow rates.

4. The combination as set forth in claim 1, at least a portion of the length of said hose being of ovoid cross-section, to facilitate the insertion of said hose portion behind said plastic liner, and to facilitate at least partial wrapping of said liner in conforming relation with said ovoid hose portion, in use to diminish the downward leakage of air between said plastic liner and said hose.

5. The combination as set forth in claim 1, said machine including a tubular mounting frame having a pair of upstanding leg portions to which said machine is secured, to facilitate location of said machine beside said pool bowl.

* * * * *